US009865932B2

(12) United States Patent
Yukimasa

(10) Patent No.: US 9,865,932 B2
(45) Date of Patent: Jan. 9, 2018

(54) CELL AND ELECTROMAGNETIC BAND-GAP STRUCTURE

(71) Applicant: CANON KABUSHIKI KAISHA, Tokyo (JP)

(72) Inventor: Koji Yukimasa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 229 days.

(21) Appl. No.: 14/593,196

(22) Filed: Jan. 9, 2015

(65) Prior Publication Data

US 2015/0214631 A1 Jul. 30, 2015

(30) Foreign Application Priority Data

Jan. 28, 2014 (JP) ..... 2014-013634

(51) Int. Cl.
*H01Q 15/00* (2006.01)

(52) U.S. Cl.
CPC ..... *H01Q 15/006* (2013.01); *H01Q 15/008* (2013.01)

(58) Field of Classification Search
CPC ..... H01Q 15/006; H01Q 15/008
See application file for complete search history.

(56) References Cited

U.S. PATENT DOCUMENTS

| | | | | |
|---|---|---|---|---|
| 8,890,761 | B2 * | 11/2014 | Toyao | H01P 1/2005 343/700 MS |
| 2009/0315648 | A1 * | 12/2009 | Toyao | H01P 1/2005 333/238 |
| 2011/0031007 | A1 * | 2/2011 | Kim | H05K 1/0236 174/377 |
| 2011/0134010 | A1 * | 6/2011 | Toyao | H01P 1/2005 343/844 |
| 2015/0236427 | A1 * | 8/2015 | Asai | H01Q 15/006 343/909 |

FOREIGN PATENT DOCUMENTS

| | | | |
|---|---|---|---|
| JP | 2002-510886 | A | 4/2002 |
| JP | 2010-010183 | A | 1/2010 |
| WO | 1999/50929 | A1 | 10/1999 |
| WO | 2010/013496 | A1 | 2/2010 |

* cited by examiner

*Primary Examiner* — Dameon E Levi
*Assistant Examiner* — Jennifer F Hu
(74) *Attorney, Agent, or Firm* — Carter, DeLuca, Farrell & Schmidt, LLP

(57) ABSTRACT

A cell that configures an electromagnetic band-gap structure, comprises a first flat conductor and a second flat conductor arranged opposing each other, a first coupling conductor that is positioned between the first flat conductor and the second flat conductor, is that electrically connected to the first flat conductor, and that has an end that is not connected to the second flat conductor, a second coupling conductor electrically connected to the first flat conductor and the second flat conductor, and a first conductor strip electrically connected to an end of the first coupling conductor and the second coupling conductor.

10 Claims, 4 Drawing Sheets

CELL AND ELECTROMAGNETIC BAND-GAP STRUCTURE

BACKGROUND OF THE INVENTION

Field of the Invention

The present invention relates to electromagnetic band-gap (EBG) structures that inhibit the propagation of electromagnetic waves in specific frequency bands.

Description of the Related Art

Electromagnetic band-gap techniques that inhibit the propagation of electromagnetic waves in specific frequency bands are currently being researched. Electromagnetic band-gap structures exhibit a magnetic wall effect, and thus are valuable when used to reduce the profile of an antenna. A mushroom structure, in which patch conductors are arranged in an array in the same plane at constant gap intervals and conduction vias are connected from the patch conductors to ground conductors that are parallel to the patch conductors (see Japanese Patent Laid-Open No. 2002-510886, for example), is generally used as an electromagnetic band-gap structure. Meanwhile, Japanese Patent Laid-Open No. 2010-010183 proposes an electromagnetic band-gap structure in which an open stub is inserted between two conductor plates arranged in parallel. Meanwhile, International Publication No. 2010/013496 discloses a electromagnetic band-gap structure configured using short stubs or open stubs on outer sides of two conductor plates arranged in parallel. An electromagnetic band-gap structure in which two open stubs having different lengths are laid in the same layer has also been proposed.

A conventional mushroom-type electromagnetic band-gap structure has a problem in that the size of a single cell is large, and thus the structure is not suited for use in small-sized electronic devices. Meanwhile, an electromagnetic band-gap structure using open stubs has a problem in that because the open stubs are longer than short stubs, an electromagnetic band-gap structure using open stubs has a larger cell size than an electromagnetic band-gap structure using short stubs. There is a further problem in that because the size of a single cell is large, the electromagnetic band-gap band (blocking band) cannot be designed with a high degree of freedom.

SUMMARY OF THE INVENTION

Having been conceived in light of the aforementioned problems, the present invention provides an electromagnetic band-gap structure having a small single cell size.

According to one aspect of the present invention, there is provided a cell that configures an electromagnetic band-gap structure, the cell comprising: a first flat conductor and a second flat conductor arranged opposing each other; a first coupling conductor that is positioned between the first flat conductor and the second flat conductor, is that electrically connected to the first flat conductor, and that has an end that is not connected to the second flat conductor; a second coupling conductor electrically connected to the first flat conductor and the second flat conductor; and a first conductor strip electrically connected to an end of the first coupling conductor and the second coupling conductor.

Further features of the present invention will become apparent from the following description of exemplary embodiments (with reference to the attached drawings).

DESCRIPTION OF THE EMBODIMENTS

First Embodiment

Figure 1:
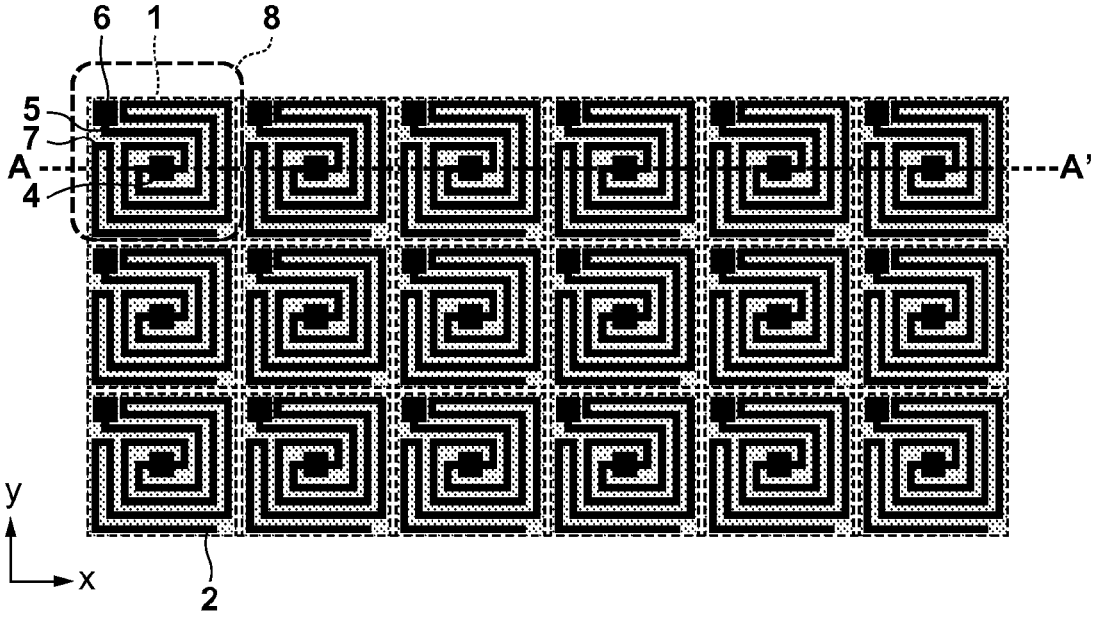
FIG. 1 is a plan view of an electromagnetic band-gap.
Figure 2:
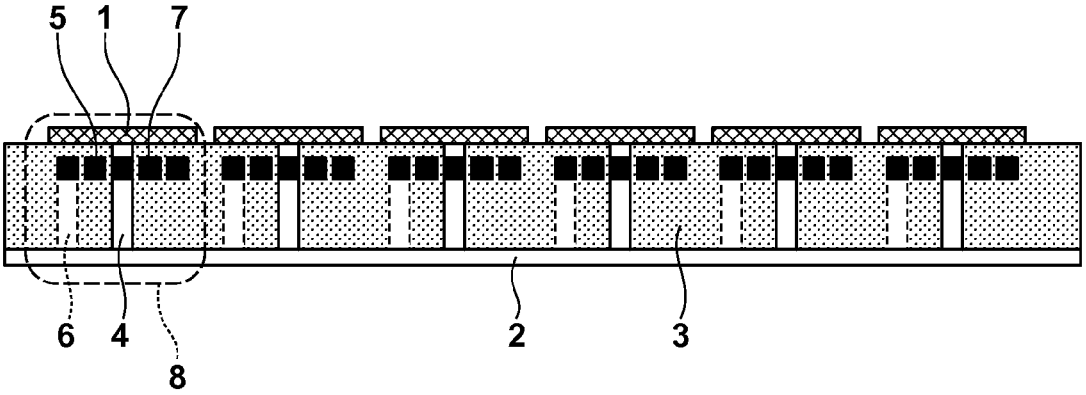
FIG. 2 is a cross-sectional view taken along an A-A' line, according to a first embodiment.

FIG. 1 is a plan view of an electromagnetic band-gap structure according to the present embodiment. FIG. 2 is a cross-sectional view taken along an A-A' line in an x direction shown in FIG. 1. Note that in the drawings, identical reference numerals indicate identical or corresponding elements. The electromagnetic band-gap structure according to the present embodiment has a configuration in which unit cells 8 are arranged in a regular manner one-dimensionally or two-dimensionally, with each unit cell 8 being rotated or not rotated. Each unit cell 8 is configured of a conductor patch 1, a ground conductor 2, a dielectric material 3 that fills the conductor patch 1 and the ground conductor 2, a via (coupling conductor) 4, a short stub 5, a short via 6, and an open stub 7. Note that "stub" refers to a conductor strip.

The via 4 is electrically connected to the conductor patch 1 and the ground conductor 2, which are flat conductors arranged opposing each other, and is also electrically connected to one end of the short stub 5 and the open stub 7. The short via 6 is electrically connected to another end of the short stub 5 and the ground conductor 2, and serves as a short terminal. Another end of the open stub 7 is not connected to any other metal portion, and serves as an open terminal. Although the short via 6 is not present in the A-A' plane shown in FIG. 1, it is illustrated for descriptive purposes as a dotted line in FIG. 2. The short stub 5 is connected to the end of the short via 6 that serves as the short terminal and the via 4, and the open stub 7 is connected to the via 4 with the other end of the open stub 7 being free.

Figure 3:
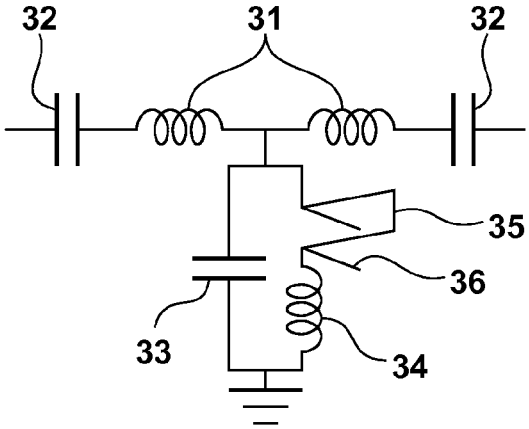
FIG. 3 is an equivalent circuit diagram illustrating a unit cell according to the first embodiment.

FIG. 3 is an equivalent circuit diagram illustrating the unit cell 8, indicated by the dotted line frame in FIGS. 1 and 2. The equivalent circuit of the unit cell 8 is configured of a serial element and a parallel element. The serial element is configured of series inductances 31 in the conductor patch 1 and series capacitances 32 in a gap formed with the conductor patch of an adjacent cell. The parallel element is configured of a parallel capacitance 33 realized by capacitive coupling between the conductor patch 1 and the ground conductor 2, and a series circuit configured of an inductance 34 and series reactances 35 and 36 in the via 4. Here, the reactances 35 and 36 indicate reactances based on the short stub 5 and the open stub 7, respectively. Specifically, the reactances 35 and 36 have capacitances or inductivities based on the length, width, and so on of the short stub 5 and the open stub 7, as well as the frequency of a combined admittance thereof.

Figure 4:
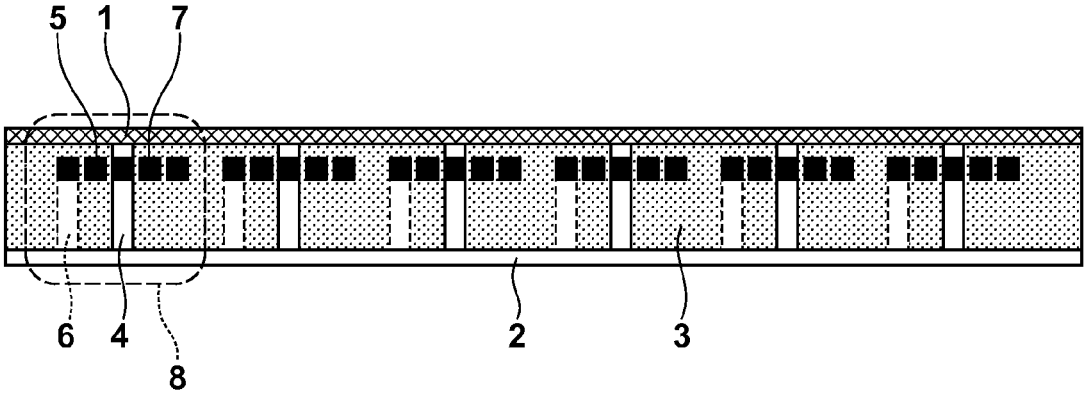
FIG. 4 is a cross-sectional view of an electromagnetic band-gap according to the first embodiment.
Figure 5:
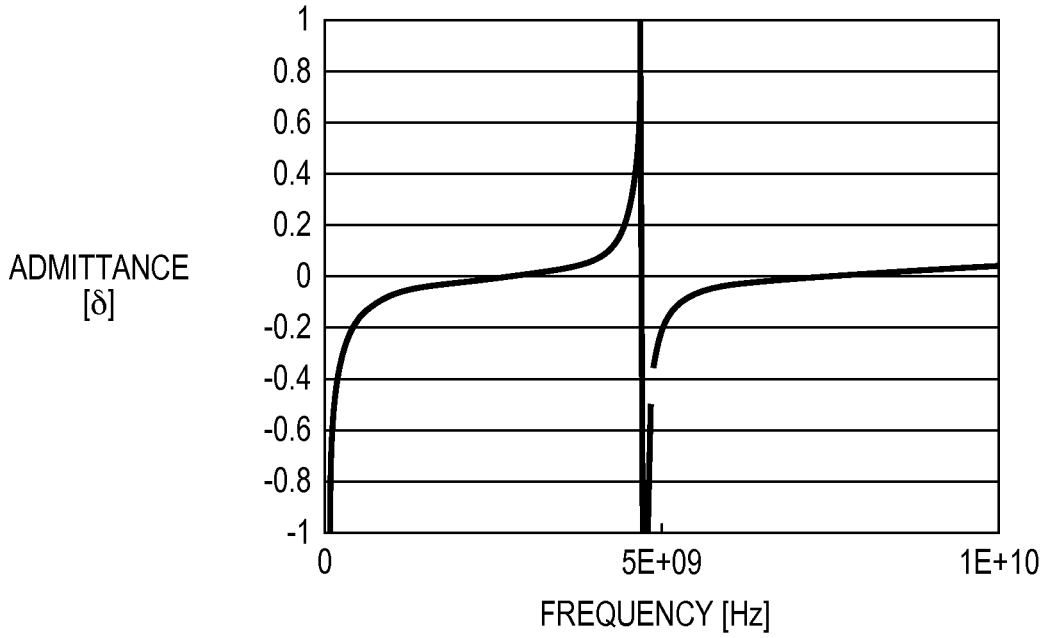
FIG. 5 is a graph illustrating frequency characteristics of a combined admittance in a unit cell according to the first embodiment.

FIG. 4 illustrates a variation on the electromagnetic band-gap structure shown in FIG. 2. In the electromagnetic band-gap structure shown in FIG. 4, there is no gap between conductor patches 1 in the horizontal direction, and as such, the conductor patches 1 are connected. In other words, the conductor patch 1 and the ground conductor 2 configure parallel plates. The equivalent circuit for such a configuration corresponds to the circuit shown in FIG. 3 with the series capacitances 32 omitted. FIG. 5 illustrates frequency characteristics below 10 GHz for the combined admittance of the parallel element shown in FIG. 4, and illustrates calculated values when the length of the short stub is 5 mm and the length of the open stub is 7 mm. Inductivity is exhibited in frequency ranges where the combined admittance is less than 3 GHz and between 5 GHz and 8 GHz, whereas capacitance is exhibited in frequency ranges where the combined admittance is between 3 GHz and 5 GHz and greater than 8 GHz.

Figure 6:
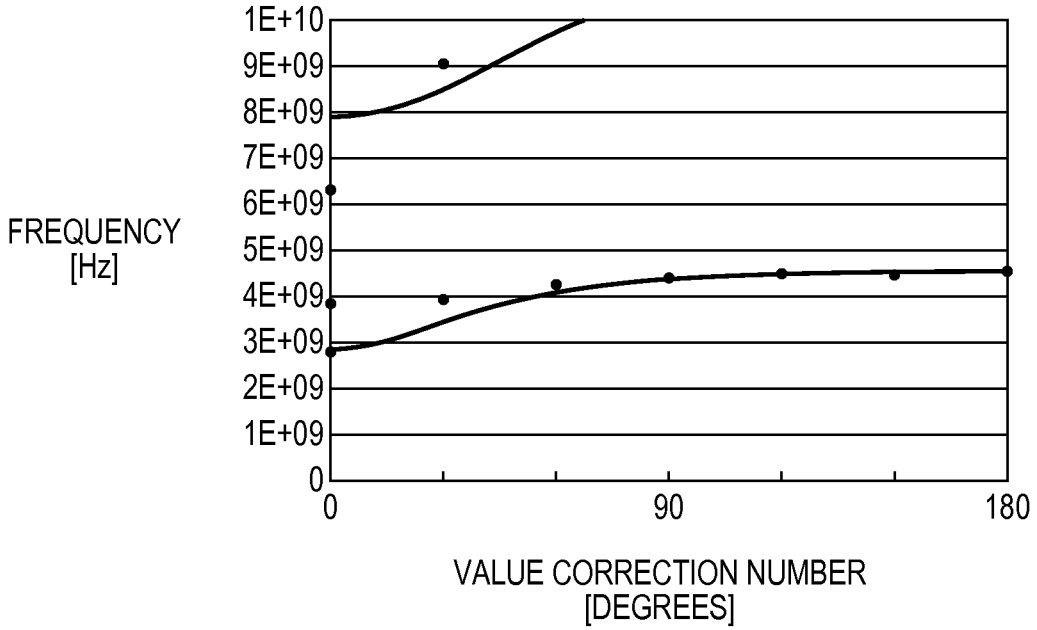
FIG. 6 is a graph illustrating unit cell distribution characteristics according to the first embodiment.

FIG. 6 illustrates distribution characteristics of the unit cell in the electromagnetic band-gap structure according to the present embodiment. In FIG. 6, the solid line indicates calculated values for an equivalent circuit when the short stub is 5 mm and the open stub is 7 mm. The black dots indicate results of an electromagnetic field analysis. The parameters used for the circuit calculations and the analysis are as follows: the size of the unit cell 8 is 1.9×1.7 mm; the height of the via 4 is 0.06 mm; the height of the short via 6 is 0.4 mm; the diameter of the via 4 and the short via 6 is 0.25 mm; the interval to the adjacent conductor patch 1 is 0.1 mm; and the width of the short stub 5 and the open stub 7 is 0.1 mm. A dielectric constant of the dielectric material 3 was set to 4.4. At this time, frequency ranges of less than 2.8 GHz and 4.6 to 6.3 GHz, where a phase constant is 0, serve as a band-gap (blocking region).

According to the present embodiment as described thus far, the size of the unit cell can be reduced by providing the short stub and the open stub in the same layer between the two conductors in the unit cell.

Although the present embodiment describes two stubs, namely the short stub 5 and the open stub 7, as being employed in the electromagnetic band-gap structure, there may be any number of stubs as long as there are at least two. Furthermore, although the present embodiment is configured using the short stub 5 and the open stub 7, any configuration may be employed as long as there is at least one short stub provided; for example, the configuration may employ only short stubs.

In addition, although the short via 6 serves as a short terminal, a clearance may be provided for the conductor patch 1, and the short via 6 may serve as a through-via. Furthermore, although the short via 6 makes contact with the ground conductor 2 in FIG. 2, the short via 6 may make contact with the conductor patch 1. The layout of the short stub 5 and the open stub 7 is not limited to that shown in FIGS. 1 and 2, and a meandering shape, a straight line shape, or the like may be employed as well, as long as the stubs have a desired length. Furthermore, although it is not necessary for the position of the short via 6 to be on an outer peripheral side of the open stub 7 and the short stub 5, or in other words, in the periphery of the outer side within the ground conductor 2, a small-size layout can be realized by providing the short via 6 on the outer peripheral side of the open stub 7 and the short stub 5. The equivalent circuit in this case corresponds to the circuit shown in FIG. 3 with the series capacitances 32 omitted. Finally, the positions of the short stub 5 and the open stub 7 are not limited to those described in the present embodiment, and may be on the outer side of the conductor patch 1 and the ground conductor 2.

Second Embodiment

Figure 7:
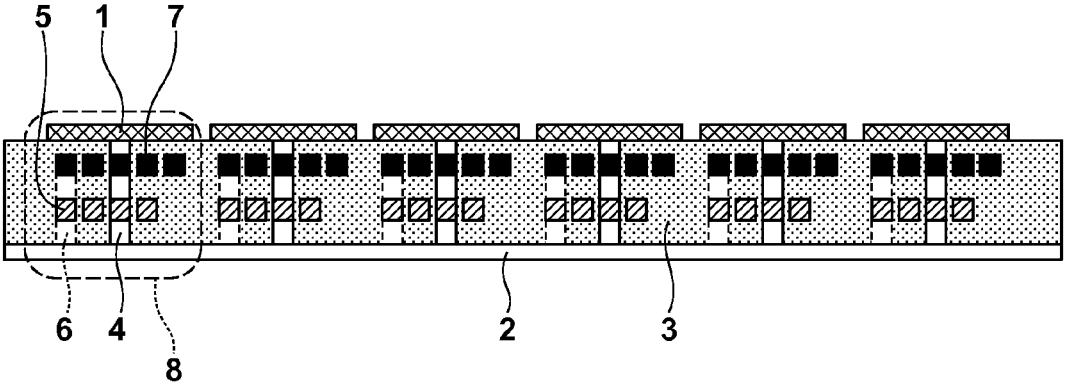
FIG. 7 is a cross-sectional view taken along an A-A' line, according to a second embodiment.

The cross-section of an electromagnetic band-gap structure according to the present embodiment is the same as that shown in FIG. 1. FIG. 7 is a plan view along the A-A' plane shown in FIG. 1. In the drawings, identical reference numerals indicate elements that are identical to or correspond to those in the first embodiment. The electromagnetic band-gap structure according to the present embodiment has a configuration in which unit cells 10 are arranged in a regular manner one-dimensionally or two-dimensionally. Each unit cell 10 is configured of the conductor patch 1, the ground conductor 2, the dielectric material 3 that fills the conductor patch 1 and the ground conductor 2, the via 4, the short stub 5, the short via 6, and the open stub 7. The unit cell 10 according to the present embodiment differs from the first embodiment in that the stubs are arranged in different layers.

The via 4 is electrically connected to the conductor patch 1 and the ground conductor 2, which are flat conductors, and is also electrically connected to one end of the short stub 5 and the open stub 7. The short via 6 is electrically connected to another end of the short stub 5 and the ground conductor 2, and serves as a short terminal. Another end of the open stub 7 is not connected to any other metal portion, and serves as an open terminal. Although the short via 6 is not present in the A-A' plane shown in FIG. 1, it is illustrated for descriptive purposes as a dotted line in FIG. 7.

Figure 8:
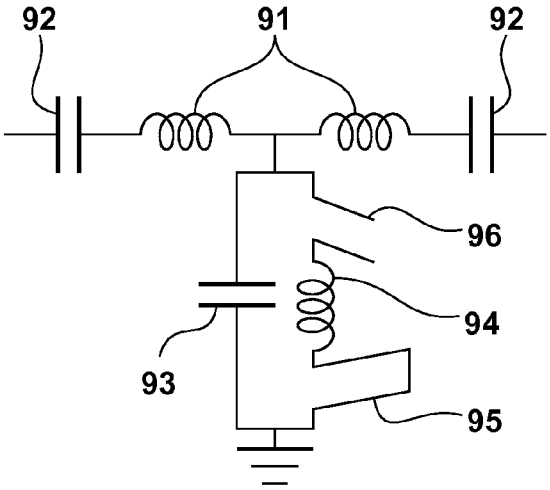
FIG. 8 is an equivalent circuit diagram illustrating a unit cell according to the second embodiment.

FIG. 8 is an equivalent circuit diagram illustrating the unit cell 10, indicated by the dotted line frame in FIGS. 1 and 7. The configuration is different from that shown in FIG. 3 in that a reactance 95 of the short stub 5 and a reactance 96 of the open stub 7 are configured in series. The other configurations are the same as the equivalent circuit shown in FIG. 3, and thus descriptions thereof will be omitted.

According to the present embodiment as described thus far, the size of the unit cell can be reduced, as in the first embodiment, by providing the short stub and the open stub in different layers between the two conductors in the unit cell.

Although the stubs are connected in series in the present embodiment, the stubs may be connected in parallel, for example, as long as the stubs are arranged in different layers. Furthermore, although the present embodiment describes two stubs, namely the short stub 5 and the open stub 7, as being employed in the electromagnetic band-gap structure, there may be any number of stubs as long as there are at least two. Further still, although the present embodiment is configured using the short stub 5 and the open stub 7, the same effects can be achieved even in the case where only open stubs or short stubs are employed in the configuration.

In addition, although the short via 6 employs an interlayer via between the ground conductor 2 and the short stub 5 in FIGS. 1 and 7, the same effects can be achieved even in the case where a through-via is employed. In this case, a clearance is provided to prevent conduction to layers aside from those in which the ground conductor 2 and the short stub 5 are provided, with the stubs in the other layer being laid out so as to avoid the clearance. The layout of the short stub 5 and the open stub 7 is not limited to that shown in FIGS. 1 and 7, and a meandering shape, a straight line shape, or the like may be employed as well, as long as the stubs have a desired length.

According to the present embodiment as described thus far, the size of the unit cell can be reduced by providing the short stub and the open stub in different layers between the two conductors in the unit cell.

The present invention is an electromagnetic band-gap structure, and unnecessary electromagnetic waves can be blocked by applying the present invention in the ground of a circuit board, areas where current is to be inhibited, and so on.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-013634, filed Jan. 28, 2014 which is hereby incorporated by reference herein in its entirety.

What is claimed is:

1. A cell that configures an electromagnetic band-gap structure, the cell comprising:

a first flat conductor and a second flat conductor arranged opposing each other;

a first coupling conductor that is positioned between the first flat conductor and the second flat conductor, is electrically connected to the first flat conductor, and has an end that is not connected to the second flat conductor;

a second coupling conductor electrically and directly connected to the first flat conductor and the second flat conductor;

a first conductor strip electrically connected to an end of the first coupling conductor and the second coupling conductor; and a second conductor strip electrically connected to the second coupling conductor and whose other end is free, wherein the second conductor strip is positioned between the first flat conductor and the second flat conductor, and wherein the first conductor strip and the second conductor strip are arranged in the same layer.

2. The cell according to claim 1, further comprising:

another first conductor strip electrically connected to an end of the first coupling conductor and the second coupling conductor.

3. The cell according to claim 2, wherein an interval from the first flat conductor to the first conductor strip and an interval from the first flat conductor to the other first conductor strip are different.

4. The cell according to claim 1, wherein an interval from the first flat conductor to the first conductor strip and an interval from the first flat conductor to the second conductor strip are different.

5. The cell according to claim 1, wherein the first coupling conductor is electrically connected to a periphery of one of the first flat conductor and the second flat conductor.

6. The cell according to claim 1, wherein the first coupling conductor penetrates a clearance provided for the second flat conductor.

7. The cell according to claim 1, wherein the first flat conductor and the second flat conductor are the same size.

8. The cell according to claim 1, wherein the first flat conductor and the second flat conductor are different sizes.

9. An electromagnetic band-gap structure in which the cell according to claim 1 is arranged in multiple, one-dimensionally or two-dimensionally and in a regular manner, without the cells being rotated.

10. An electromagnetic band-gap structure in which the cell according to claim 1 is arranged in multiple, one-dimensionally or two-dimensionally and in a regular manner, with the cells being rotated.

* * * * *